United States Patent [19]

Greenwell

[11] 3,996,723

[45] Dec. 14, 1976

[54] ARTICLE COLLATOR

[75] Inventor: Joseph Daniel Greenwell, Florence, Ky.

[73] Assignee: R. A. Jones & Company, Inc., Covington, Ky.

[22] Filed: Mar. 28, 1975

[21] Appl. No.: 563,095

[52] U.S. Cl. ..... 53/59 R; 53/62; 53/164; 214/6 DK

[51] Int. Cl.[2] ..... B65B 57/10; B65B 57/20

[58] Field of Search ..... 53/59 R, 62, 164; 198/21; 214/6 DK

[56] References Cited

UNITED STATES PATENTS

| | | | |
|---|---|---|---|
| 3,193,078 | 7/1965 | Amenta et al. | 53/59 RX |
| 3,512,336 | 5/1970 | Rosecrans | 53/164 |
| 3,641,735 | 2/1972 | Daily et al. | 53/164 |
| 3,729,895 | 5/1973 | Kramer et al. | 53/59 R |
| 3,817,368 | 6/1974 | Wentz et al. | 198/21 |

*Primary Examiner*—Travis S. McGehee
*Attorney, Agent, or Firm*—Wood, Herron & Evans

[57] ABSTRACT

A collator having an upper receiver for receiving a layer of articles, a lower receiver for accumulating multiple layers of articles and trap doors for the receivers. A swinging conveyor is pivoted at its upper end and means are provided to swing its lower end to any of a plurality of discharge points adjacent said upper receiver. Control means including counters are provided to count articles as they pass from the swinging conveyor to the upper receiver and when a preselected number is received by the upper conveyor, its trap door is operated to drop that group into the lower receiver. Several such drops are made until the desired total is accumulated, whereupon the trap door for the lower receiver is opened to drop the accumulated group into a receptacle.

12 Claims, 15 Drawing Figures

ARTICLE COLLATOR

This invention relates to a collator by which articles, individually conveyed to the collator, are assembled in layers and deposited into a receptacle.

In commerce there are many instances when it is desired to pack articles in a more or less organized fashion into cartons. In packing them, it is necessary to count them so that each carton has the same number and to organize them into layers so that they can be efficiently and economically packed in cartons more or less precisely sized for the number of articles to be packed.

These counting, collating and packing operations are normally performed manually simply because of the fact that there has not been commercially available equipment which can satisfactorily perform all of the operations and still have the degree of versatility to accommodate varying numbers of articles as well as various sizes and shapes. A few patents have disclosed collators, but it appears that none has achieved any commerical recognition.

An objective of the present invention has been to provide a collator adapted to receive articles one at a time from a conveyor and to organize the articles into a group of several layers of the articles of the desired number and to deposit the articles into a receptacle such as a carton or a product bucket.

Another objective of the invention has been to provide a collator which can count, collate and pack articles rapidly.

Another objective of the invention has been to provide a collator which is versatile in that it can accommodate varying numbers of articles, varying layers of articles, as well as various sizes and shapes of articles.

To achieve these objectives, the invention provides a collator having a swinging conveyor which receives articles one at a time. Means are provided to count the articles passing along the conveyor and to swing the discharge end of the conveyor to the next succeeding discharge point as each article is discharged. Underlying the discharge end of the conveyor are upper and lower receivers each having trap doors. The upper receiver has a plurality of compartments into which the conveyor discharges articles one at a time. When a first group of a preselected number of articles is received by the upper receiver, that group is dropped into the lower receiver. That operation is continued until the desired total number is accumulated, whereupon the lower trap door is opened to drop all articles into a receptacle such as a product bucket or a conventional cartoner or a tray-type carton.

A detector, preferably a photocell, is mounted on the discharge end of the conveyor to form a part of the counting means. It provides a "demand" type operation, that is, the various functions of the apparatus are performed only as determined by the actual flow of articles from the conveyor into the receivers.

The apparatus includes settable counters for the total number of packs, the number of packs in each layer, and the number of layers. This feature imparts considerable versatility to the collator in enabling it to accommodate a wide variety of numbers of articles to be packed and a variety of sizes of articles to be packed and shapes of cartons into which they are packed.

The trap door of the upper receiver is provided with a plurality of spaced parallel ribs to define compartments. The ribs also serve to cause articles which are wider that the compartment widths to assume a shingled orientation, thus adding to the versatility of the collator to accommodate articles of various sizes.

While the double drop apparatus using two receivers is not per se novel, its use in the present collator combination is particularly desirable where such high speeds are desired that it might not be possible to drop a complete accumulation of articles before the first article of the next group appears at the discharge end of the conveyor.

The present invention is suitable for intermittently operated cartoners or for continuous motion cartoners, the latter requiring a longitudinally movable second receiver, that is to say, a second receiver which moves in the direction of the receptacle into which it is dropping its articles as it is dropping its articles as shown in copending application Ser. No. 491,313, filed July 24, 1974.

The several objectives and features of the invention will become more readily apparent from the following detailed description taken in conjunction with the accompanying drawings in which.

Figure 1:
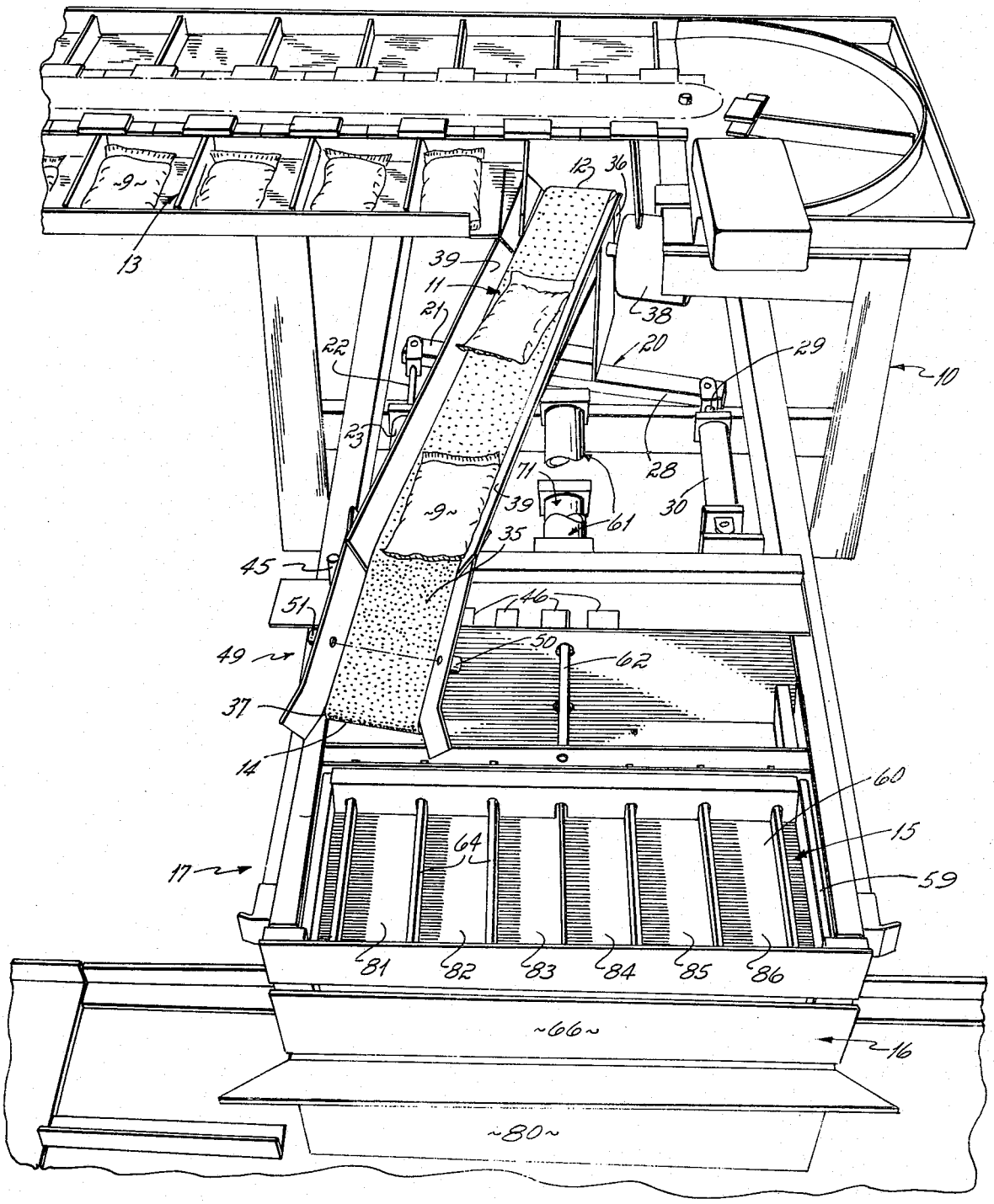
FIG. 1 is a perspective view, partially broken away, of the collator apparatus.
Figure 2:
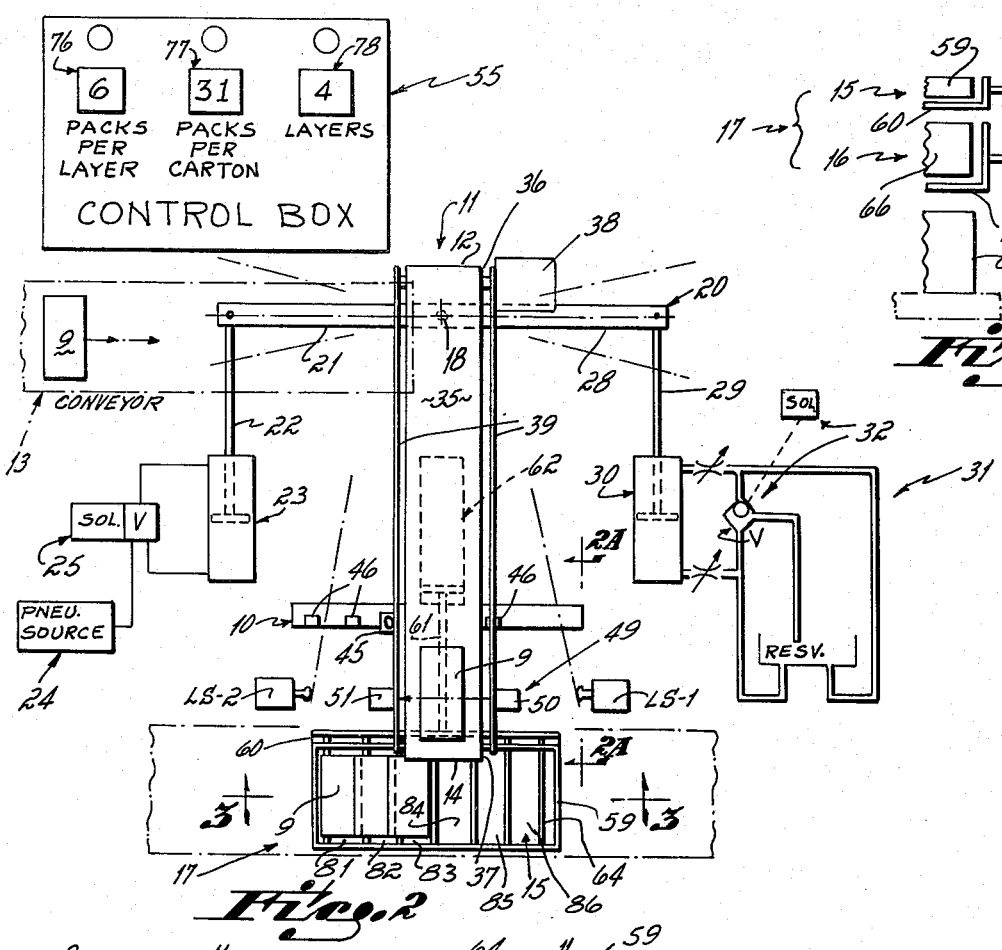
FIG. 2 is a diagrammatic plan view of the collator apparatus.
Figure 2A:
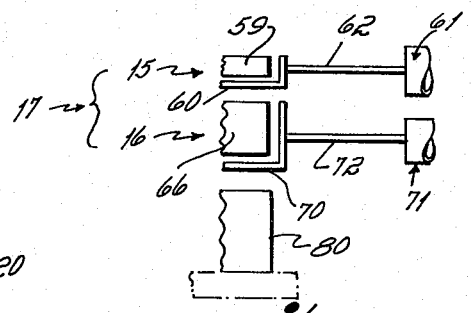
FIG. 2A is a cross sectional view taken along lines 2A—2A of FIG. 2.

Referring to FIGS. 1 and 2, the apparatus is mounted on a base 10 and includes a swinging conveyor 11 which receives articles at its upstream end 12 from a feeding conveyor 13. The conveyor 11 has a downstream end 14 overlying an accumulator 17 which has an upper receiver 15 and a lower receiver 16. The conveyor 11 is mounted to pivot about an axis 18 at its upstream end so that its downstream end swings to any one of a number of discharge points overlying the upper receiver 15.

The conveyor 11 is mounted on a crossbar 20 which is adapted to pivot about the axis 18. The crossbar has a first laterally projecting arm 21 which is connected to a piston rod 22 of a pneumatic double acting piston and cylinder 23. The double acting piston and cylinder 23 is operated from a source of air 24 under pressure through a solenoid actuated valve 25. The piston and cylinder 23 is the driver for the swinging conveyor 11. The crossbar 20 has another arm 28 projecting laterally to the side opposite arm 21 and which is connected to a rod 29 of the piston in a hyrdaulic double acting piston and cylinder 30. The double acting piston and cylinder 30 functions as a brake to stop the conveyor 11 at each of the desired discharge points. The double acting piston and cylinder 30 is connected to a hydraulic circuit 31 including a solenoid operated valve 32 which permits circulation of fluid when the conveyor is being driven by the piston and cylinder 23 and which blocks the circulation of fluid when the conveyor is to be braked at a discharge point. As an alternative to the two pistons and cylinders, the conveyor could be swung by a pulsed stepping motor.

The conveyor 11 has an endless belt 35 passing around sheaves 36 at the upstream end and 37 at the downstream end. The sheave at the upstream end is driven by a motor 38 mounted on the crossbar 20. A pair of longitudinally extending guides 39 are mounted at the conveyor on each side of the belt 35 and project above the surface of the belt to confine the articles to the belt as they pass from the conveyor 13 onto the conveyor 11 and then into the upper receiver 15.

An electric eye 45 is mounted on one of the guides 39 and is directed toward blocks of reflective indicia 46 mounted on the base 10. Each of the indicia 46 corresponds to a discharge point at which the conveyor 11 should be braked. A beam of light reflecting off these indicia into the electric eye 45 determines the angular location of the conveyor 11 and signals the solenoid operated valve 32 to brake the conveyor 11. The blocks of indicia are of substantial size and will trigger the brake at differing discharge points depending upon whether the conveyor is swinging left or right. This permits a useful orientation of the articles in the upper receiver compartments, as will appear below.

At the downstream end of the conveyor is an article detector 49 consisting of a light source 50 and an electric eye 51. The electric eye 51 generates a signal each time an article 9 interrupts the beam from the source 50 as the article 9 passes over the discharge end of the conveyor 11.

A limit switch LS-1 is on one side of the conveyor 11 and a limit switch LS-2 is on the other side of the conveyor 11. The limit switches may be moved laterally with respect to the conveyor 11 to reduce the length of its excursion when, for example, packing conditions require less than the maximum number of articles in each layer. Thus, six articles per layer can be accommodated in the illustrated form of the invention. That number can be reduced as, for example, to five by shifting limit switch LS-1 toward limit switch LS-2 by a distance equal to the dimension of one compartment. When a limit switch is engaged by the conveyor, at the end of its arcuate excursion, it signals the conveyor swinging means, that is, the circuits for the pistons and cylinders 23 and 30 to reverse the direction of their operation.

The upper receiver 15 is formed partly by a fixed rectangular frame 59 which confines the articles as they are dropped into it. Below the frame 59 is a trap door 60 which is reciprocable by a pneumatic piston and cylinder 61 connected to it by a rod 62. The trap door has a plurality of upwardly projecting spaced parallel ribs 64 which define compartments for the receipt of articles, six compartments being shown in the illustrated form of the invention.

The lower receiver 16 has a fixed rectangular frame 66 which is deeper than the rectangular frame 59 of the upper receiver, since the lower receiver will normally receive multiple layers of articles. Below the frame 66 the lower receiver has a trap door 70 which is reciprocable by a pneumatic double acting piston and cylinder 71 connected to it by a piston rod 72.

The apparatus has a control located in the control box 55 which includes three settable counters 76, 77 and 78. The control circuit utilizes conventional logic to perform the simple counting and resetting operations described below. The counter 76 counts the packs per layer and when the preselected number of packs is counted effects the operation of the piston and cylinder 61 to open the trap door 60 of the upper receiver 15. Each limit switch LS-1 and LS-2 is connected to the counter 76 to reset the counter to zero for reasons which will appear below. Counter 77 is settable to the total number of packs desired. When that number is counted, both pistons and cylinders 61 and 71 are operated to drop the total number of articles into a receptacle 80 underlying the lower receiver 16. At this point the filled receptacle is moved out and a new receptacle brought into position and all counters are reset to zero to begin recounting.

Counter 78 counts the numbers of layers which have been dropped and its use is optional. When the preselected number of layers has been dropped, trap door 70 on the lower receiver is operated to drop the partial load into a receptacle. This counter does not have to be employed when the lower receiver is deep enough to accommodate a full load. Where the lower receiver is shallow, it might accumulate a substantial portion of the full load until filled. Thereafter, using the layer counter to drop the partial load, the operation can be continued since the lower receiver will then have space to accommodate additional layers.

The operation of the invention can be understood by reference to FIGS. 3–14 taken in conjunction with FIGS. 1 and 2. Let it be assumed that it is desired to have six articles per layer and 31 total articles in the carton. Further, let it be assumed that the lower receiver has only sufficient depth to accommodate four layers. Those determinations are entered into the control box with counter 76 being set at 6, counter 77 being set at 31 and counter 78 being set at 4.

The limit switches LS-1 and LS-2 are set the maximum distance apart since six articles in a layer is the maximum which the illustrated collator can accommodate.

At start-up, assume that the conveyor 11 overlies the first compartment on the left, as shown in FIG. 1. As the first article 9 passes the detector 49 and drops into the leftmost compartment indicated at 81, the counters 76, 77 record the fact that one article has passed into the receiver. The detector also signals the solenoid operated valve 25 to energize piston and cylinder 23 to swing the conveyor toward the next compartment 82. As the conveyor 11 reaches the compartment 82, electric eye 45 reads the appropriate indicia 46 and signals the solenoid operated valve 32 to brake the conveyor 11. Because of the width of the indicia, the conveyor will be stopped close to the leading or left (as viewed in the drawings) rib 64 defining a compartment.

It will be noted that the article 9 is wider than the space between the ribs 64 on the trap door 60 which forms the bottom wall of the upper receiver 15. Therefore, one edge of the article falls on the trap door 60 and the other edge of the article is slightly elevated by engagement of the article with the rib 64 so as to begin a shingled orientation of the articles.

The operation continues with the discharge of articles into compartments 82–86 until a layer of six has been deposited in the upper receiver 15. This number of articles having been counted by the counter 76, the trap door 60 of the upper receiver is pulled, by the piston and cylinder 61, out of the receiver 15 to drop the layer of six articles into the lower receiver 16. That first drop is counted by the layer counter 78. The conveyor 11 continues to swing until it engages limit switch LS-1 which, when contracted, effects a reversal of the circuits of solenoid operated valves 25 and 32 so as to condition the conveyor 11 for swinging movement toward the left as viewed in FIG. 1.

The conveyor 11 then swings to a position overlying compartment 86 where it is braked and the first article of the second layer is deposited. The conveyor continues to swing toward the left and serially deposits articles in the compartments 86–81. Note that the ribs 64 of the trap door 60 cause a shingling in the opposite direction as caused by the width of the indicia 46. Thus, each article, which is wider than the compartment, will not be obstructed by the preceding article dropped into the preceding compartment.

Figures 3, 4, 5, 6, 7, 8, 9, 10, 11, 12, 13, 14:
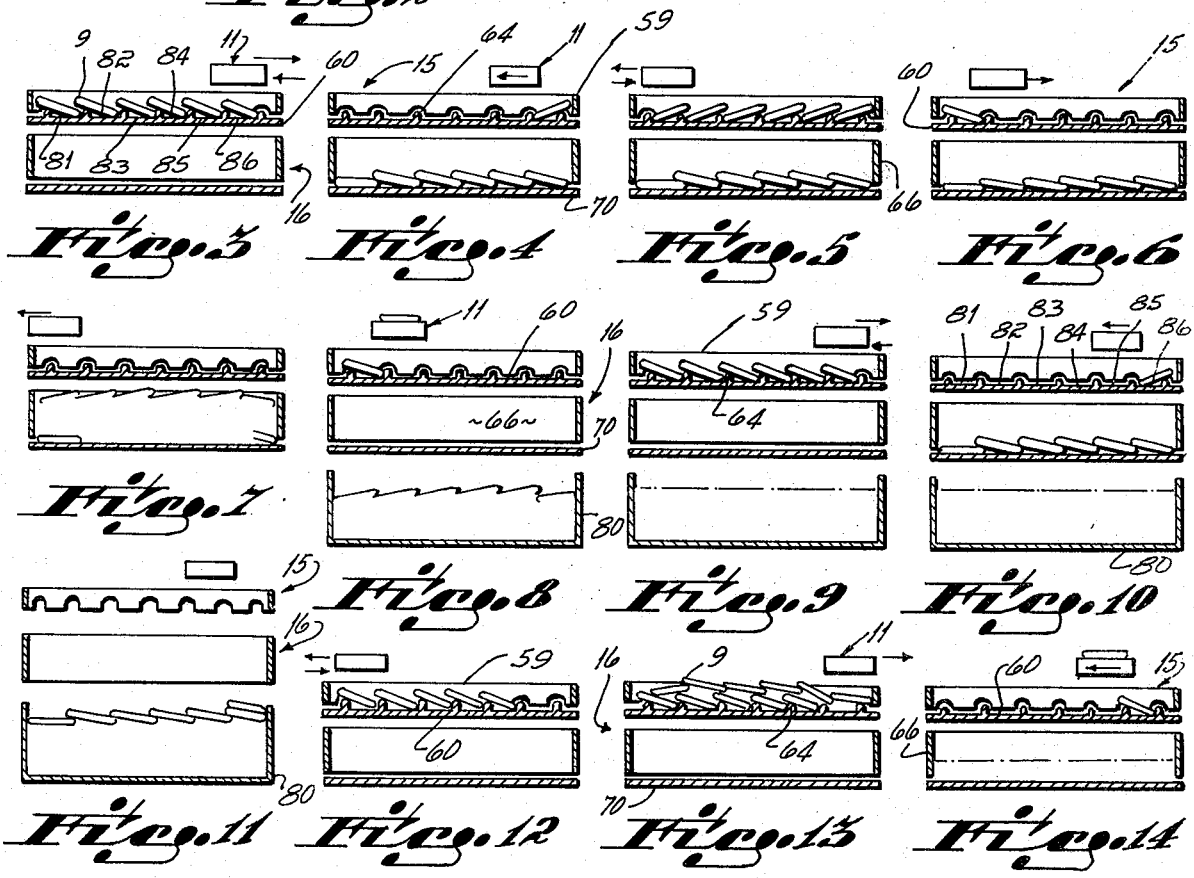
FIGS. 3–14 are cross sectional views taken along lines 3—3 of FIG. 2 illustrating the sequence of operation.

When the sixth article is received, trap door 60 is again withdrawn to drop that group into the lower receiver, as shown in FIG. 6. That excursion back and forth is continued until four layers have been dropped, as shown in FIG. 7. Upon the dropping of the fourth layer, the layer counter 78 triggers the operation of the trap door 70 in the lower receiver to cause all accumulated (24) articles to drop into the receptacle 80 (FIG. 8).

The operation continues to deposit a group of six more articles in the upper receiver (FIG. 9) which is thereupon dropped into the lower receiver. On the return leftward excursion of the conveyor a final article (FIG. 10) is dropped into upper receiver 15, now making the total 31. When the total of 31 is counted by the counter 77, both trap doors 60 and 70 are withdrawn to drop the remaining seven articles into the receptacle 80 (FIG. 11).

At this point, the conveyor 11 has begun a leftward excursion and now overlies compartment 85. It continues to deposit articles in a leftward excursion, dropping five articles into compartments 85 to 81 (FIG. 12). When the fifth article is dropped into compartment 81, the conveyor 11 continues to swing leftward until limit switch LS-2 is engaged which resets the packs per layer counter 76 to zero. The conveyor will then swing back to overlie compartment 81 and continue to drop six more articles in the respective compartments 81–86 on top of the first five which were dropped. The accumulation of 11 articles in the upper receiver is permitted by virtue of the resetting of the packs per layer counter to zero after five were dropped. Thereafter, the discharge of articles into the receiver and the dropping of them into the lower receiver and finally the receptacle 80 continues as described above until a total of 31 has been dropped. Thus, no matter where the conveyor is located at the beginning of a load, the system will operate until a load of 31 has been dropped.

I claim:

1. A collator for articles comprising, a conveyor pivoted at its upstream end to swing its downstream end to any of a number of discharge points, means for swinging said conveyor to said discharge points to drop one of said articles at each of said discharge points, an upper receiver at said discharge end to receive articles from said conveyor, a plurality of spaced parallel ribs in said upper receiver forming a plurality of compartments for the receipt of articles at said discharge points, a lower receiver below said upper receiver for receiving a plurality of groups of articles from said upper receiver, trap doors forming the bottom walls of said receivers, and means for selectively opening said trap doors to first collect and drop a layer of articles from said upper receiver and to collect and drop a plurality of articles from said lower receiver.

2. A collator for articles as in claim 1 further comprising, an article detector at the downstream end of said conveyor, control means connected to said detector to count said articles and shift said conveyor from one discharge point to another as required to deposit a single layer of articles into said upper receiver.

3. A collator for articles as in claim 2 in which said detector includes a photoelectric cell.

4. A collator as in claim 2 in which said control means includes an adjustable counter for counting the total articles to be dropped into a receptacle, said counter causing the opening of said trap doors.

5. A collator as in claim 4 further comprising an adjustable counter for counting the articles per layer deposited in said upper receiver, said articles per layer counter causing the opening of said trap door in the upper receiver when the preselected number of articles is counted.

6. A collator for articles comprising, a conveyor pivoted at its upstream end to swing its downstream end to any of a number of discharge points, means for swinging said conveyor to said discharge points to drop one of said articles at each of said discharge points, an upper receiver at said discharge end to receive articles from said conveyor, a lower receiver below said upper receiver for receiving a plurality of groups of articles from said upper receiver, trap doors forming the bottom walls of said receivers, means for selectively opening said trap doors to first collect and drop a layer of articles from said upper receiver and to collect and drop a plurality of articles from said lower receiver, an article detector at the downstream end of said conveyor, an adjustable counter connected to said detector for counting the total articles to be dropped into a receptacle, said counter causing the opening of said trap doors, an adjustable counter for counting the articles per layer deposited in said upper receiver, said articles per layer counter causing the opening of said trap door at the upper receiver when the preselected number of articles is counted, limit switches on each side of said conveyor, said limit switches being operable to reset said articles per layer counter to zero whereby to permit said upper receiver to receive a full layer and a partial layer before its trap door opens.

7. A collator for articles comprising, a conveyor pivoted at its upstream end to swing its downstream end to any of a number of discharge points, means for swinging said conveyor to said discharge points to drop one of said articles at each of said discharge points, an upper receiver at said discharge end to receive articles from said conveyor, a lower receiver below said upper receiver for receiving a plurality of groups of articles from said upper receiver, trap doors forming the bottom walls of said receivers, means for selectively opening said trap doors to first collect and drop a layer of articles from said upper receiver and to collect and dorp a plurality of articles from said lower receiver, an article detector at the downstream end of said conveyor, an adjustable counter connected to said detector for counting the total articles to be dropped into a receptacle, said counter causing the opening of said trap doors, an adjustable counter for counting the articles per layer deposited in said upper receiver, said articles per layer counter causing the opening of said trap door at the upper receiver when the preselected number of articles is counted, an adjustable counter for counting the layers dropped into said lower receiver and operable to cause said trap door of said lower receiver to operate when a preselected number of layers is counted.

8. A collator for articles comprising, a conveyor pivoted at its upstream end to swing its downstream end to any of a number of discharge points, means for swinging said conveyor to said discharge points to drop one of said articles at each of said discharge points, a receiver for articles located at the downstream end of said conveyor, a trap door forming the bottom wall of said receiver, an article detector at the downstream end of said conveyor, control means connected to said detector to count said articles and shift said conveyor from one discharge point to another as each article passes the discharge end of said conveyor, and a plurality of spaced parallel ribs on the upper surface of said trap door extending generally in the direction of said conveyor and forming compartments at each of said discharge points for the receipt of said articles.

9. A collator as in claim 8 in which said ribs are spaced apart a distance less than the width of the articles, thereby causing said articles to be deposited on said trap door in shingled relation.

10. A collator as in claim 8 and means for stopping said conveyor close to the leading rib of each compartment to cause articles to be shingled in two different orientations dependent upon the direction of movement of said conveyor.

11. A collator for articles comprising, a conveyor pivoted at its upstream end to swing its downstream end to any of a number of discharge points, means for swinging said conveyor to said discharge points to drop one of said articles at each of said discharge points, a receiver for articles located at the downstream end of said conveyor, a trap door forming the bottom wall of said receiver, an article detector at the downstream end of said conveyor, control means connected to said detector to count said articles and shift said conveyor from one discharge point to another as each article passes the discharge end of said conveyor, said conveyor swinging means comprising, a first fluid-operated double-acting piston and cylinder connected to said conveyor to cause said conveyor to swing, a second fluid-operated double-acting piston and cylinder connected to said conveyor to brake said conveyor, and means for operating said pistons and cylinders.

12. A collator as in claim 11 in which said operating means includes an electric eye mounted on said conveyor, a series of fixed spaced indicia readable by said electric eye, each of said indicia corresponding to a discharge point, and means connecting said electric eye to said second piston and cylinder to brake said conveyor at each discharge point.

* * * * *